US005118983A

United States Patent [19]

Morita et al.

[11] Patent Number: 5,118,983

[45] Date of Patent: Jun. 2, 1992

[54] THERMIONIC ELECTRON SOURCE

[75] Inventors: Noriko Morita; Susumu Hoshinouchi; Yoshihiko Kusakabe, all of Amagasaki, Japan

[73] Assignee: Mitsubishi Denki Kabushiki Kaisha, Japan

[21] Appl. No.: 495,127

[22] Filed: Mar. 19, 1990

[30] Foreign Application Priority Data

| | | | |
|---|---|---|---|
| Mar. 24, 1989 | [JP] | Japan | 1-72622 |
| Jul. 10, 1989 | [JP] | Japan | 1-178707 |
| Jul. 12, 1989 | [JP] | Japan | 1-181034 |

[51] Int. Cl.[5] ..... H01J 1/24

[52] U.S. Cl. ..... 313/340; 313/270; 313/337; 313/346 R; 313/355; 313/345; 219/543; 338/307; 338/308; 338/314

[58] Field of Search ..... 313/270, 337, 340, 346 R, 313/355, 345; 219/543; 338/307, 308, 314

[56] References Cited

U.S. PATENT DOCUMENTS

| | | | |
|---|---|---|---|
| 1,826,510 | 10/1931 | Driggs | 313/340 |
| 1,980,675 | 11/1934 | Frendburgh | 313/340 |
| 2,011,173 | 8/1935 | Crowley | 313/340 X |
| 3,495,120 | 2/1970 | Knippenberg et al. | 313/270 |
| 3,748,522 | 7/1973 | Geppert | 313/310 |
| 3,753,025 | 8/1973 | Van Stratum et al. | 313/270 |
| 3,986,065 | 10/1976 | Pankore | 313/346 R X |
| 4,053,807 | 10/1977 | Aozuka et al. | 313/409 |
| 4,057,707 | 11/1977 | Allen | 219/543 |
| 4,069,436 | 1/1978 | Nakayama et al. | 313/302 |
| 4,139,833 | 2/1979 | Kirsch | 338/308 |
| 4,569,796 | 3/1971 | Takanashi | 313/346 R |
| 4,916,356 | 4/1990 | Ahern et al. | 313/346 R X |
| 4,978,814 | 12/1990 | Honour | 219/543 X |

FOREIGN PATENT DOCUMENTS

| | | | |
|---|---|---|---|
| 0051474 | 4/1979 | Japan | 313/346 R |
| 55-24646 | 6/1980 | Japan . | |
| 0829488 | 3/1960 | United Kingdom | 313/355 |
| 1188668 | 4/1970 | United Kingdom | 313/340 |

OTHER PUBLICATIONS

Schmid et al., "Titanium Impurity . . . Cathodes", Applications of Surface Science 21, pp. 37–49, Dec. 1985.

*Primary Examiner*—Donald J. Yusko
*Assistant Examiner*—Ashok Patel
*Attorney, Agent, or Firm*—Leydig, Voit & Mayer

[57] ABSTRACT

A high temperature low density operating element includes a porous high temperature operating element film formed into a predetermined configuration and disposed on one surface of an insulating member with good heat conductivity, a resistive film with a high melting point and good heat conductivity having a higher density than the high temperature operating element film, formed into a predetermined configuration on a second surface of the insulating member with good heat conductivity, a lead wire connected to the resistive film, an insulating protective film disposed on the insulating member covering the resistive film.

5 Claims, 8 Drawing Sheets

THERMIONIC ELECTRON SOURCE

FIELD OF THE INVENTION

The present invention relates to a structure of a high temperature operating element which is heated by a heater and, more particularly, to a laminated type electron emitting element which effectively emits electrons at a temperature of approximately 1000° C. using thermionic emission, such as an electron gun for a cathode ray tube, a hot cathode X-ray tube, an electron microscope or the Braun tube. In addition, the present invention relates to a method for manufacturing a heater for heating to a high temperature of approximately 1000° C., such as a compact heater for heating the high temperature operating element or a heater for the electron gun.

BACKGROUND OF THE INVENTION

Heretofore, a high temperature operating element has been manufactured using a so-called thick film circuit forming technique such as screen printing, as disclosed in Japanese Published Patent Application 55-24646. FIG. 7 is a sectional view showing the thus manufactured conventional high temperature operating element. First, a raw material for forming a ceramic substrate 10 is prepared and a heat generating layer 11 having a predetermined configuration is formed on a sheet by a printing technique such as extrusion through a roll or a casting method. Then, an insulator 12 is formed on the substrate 10 with the heat generating layer 11 formed thereon and then a cathode lead layer 13, a base metal layer 14 and a cathode material layer 15 are formed on this insulator 12 by the same printing method, so that the high temperature operating element is formed. The heat generating layer 11 is formed on the substrate 10 by screen printing a paste in which a baking assistant is applied to a heater material. The operating element is formed on the substrate 10 by screen printing a paste in which the baking assistant is applied to the desired material. After the screen printing, they are baked at a high temperature (1000° C.–2000° C.) and then the high temperature operating element is formed.

In this method, a high temperature treatment is performed during manufacture. Therefore, if the heater is used below this processing temperature, the change of resistance with time is small, so that it is stable at a high temperature for a long time as a heater. However, the pattern precision obtained by screen printing is unsatisfactory and it is difficult to control (reduce) the thickness of the heat generating layer 11. Therefore, the power consumption is large and the resistance varies widely amongst a plurality of heaters. Therefore, as a method for forming a pattern with high reliability, a PVD method (Physical Vapor Deposition) and a CVD method (Chemical Vapor Deposition) have been developed.

FIGS. 8(*a*) to 8(*d*) illustrate method for manufacturing the conventional high temperature operating element by a thin film forming method. First, a resistive (heat generating) film 20 and a high temperature element film 40 are uniformly formed on opposite surfaces of a planar ceramic substrate 10, respectively. Then, a predetermined heater pattern and an element pattern are formed by etching and a lead wire 50 is connected to the heater side, whereby the high temperature operating element is produced.

FIG. 10 shows a structure of an electron emitting apparatus produced by the thin film forming method as a example of the conventional high temperature operating element. First, a resistive (heat generating) film 20 for a heater and a film for a base metal 18 (reduction member) are uniformly formed on one surface and the other surface of a planar ceramic substrate 10, respectively. Then, a desired heater pattern and a pattern for a cathode are formed by etching and an electron emitting member 19 is applied to the base metal film. A lead wire 50 is connected to the heater side, whereby an electron emitting apparatus is produced.

A description is given of a method for manufacturing a conventional planar thin heater used in such a high temperature operating element. FIGS. 11(*a*) to 11(*d*) are process diagrams showing a method for manufacturing the planar thin heater by the conventional thin film forming method. For example, a resistive (heat generating) film 30 for heater is uniformly formed on a planar ceramic substrate 10 of $Al_2O_3$ (FIG. 11 (*b*)), then a desired heater pattern is formed by etching (FIG. 11(*c*)) and then, a lead wire 50 is connected thereto (FIG. 11(*d*)). As a result, the planar thin heater is provided.

In the conventional high temperature operating element produced by the above method, the resistance changes while it is used as a planar thin heater with a voltage applied to the lead wire 50. This is because the resistive (heat generating) film 20 is thin. FIG. 9 shows a change of a resistance value of the heater with time. In FIG. 9, the ordinate designates a resistance value and the abscissa designates time. As shown in the FIG. 9, resistance falls at an early stage because the thin film is recrystallized and crystalline grains in the film grow in size. For example, when the resistive (heat generating) film 20 is W (tungsten) and it is used at 1000° C., it is recrystallized because 1000° C. is the recrystallization temperature of W. In addition, resistance increases with time because impurities enter the film from the ambient or the film is oxidized. Therefore, it is not stable as a heater and reliability over a long period of time is not guaranteed.

Since an oxide substrate such as $Al_2O_3$ is readily available in a monocrystalline state and can be ground to a mirror finish, the patterning precision thereon is better than that of a sintered substrate such as SiC and AlN. However, in a heater using an oxide substrate such as $Al_2O_3$ as shown in FIG. 11, a part of the substrate below the resistance wiring end is selectively damaged by thermochemical or electrochemical action caused by oxygen during its use. As shown in the photograph 3 showing a sectional view of an end of the conventional planar thin heater of the high temperature operating element after its use, this damage causes reduced heater life.

In addition, in the high temperature operating element such as an electron emitting apparatus provided by the thus described method, the film peels off the substrate 10 when a voltage is applied to the lead wire to heat the heater and the cathode is heated through the ceramic substrate 10 to emit electrons. More specifically, the resistive film 20 peels off the ceramic substrate 10 or the ceramic base metal film 18 peels off in the structure shown in FIG. 10. The reason for this is that an adhering force between the film and the substrate is originally weak, a change in a balance of an internal stress occurs due to the heating and cooling during its use and thermal expansion coefficients of the film and the substrate are different. Therefore, heat capacity changes due to the peeling off, the resistance value as a heater fluctuates, a wire breaks in the heater and the amount of electron emission from the cathode changes with the change of the heat capacity. Furthermore, the base metal (reduction member) film 18 does not well adhere to the cathode material and an electron emitting characteristics deteriorate, therefore the heater and the cathode are unstable and long-term reliability is reduced. Therefore, performance is not satisfactory.

As described above, the conventional high temperature operating element is formed alternatively by providing a porous film with low film density on both surfaces of a substrate by a thick film circuit forming technique or by providing a film with high film density and with a less adherence by a thin film forming method. However, these techniques do not produce satisfactory heater performance.

SUMMARY OF THE INVENTION

The present invention was made in order to solve the conventional problem and it is an object of the present invention to provide a high temperature operating element with long-term high reliability having a thin film high temperature heater with high reliability in which resistance changes little and the film is not likely to peel off the substrate during its use.

Other objects and advantages of the present invention will become apparent from the detailed description given hereinafter; it should be understood, however, that the detailed description and specific embodiment are given by way of illustration only, since various changes and modifications within the spirit and scope of the invention will become apparent to those skilled in the art from this detailed description.

According to a high temperature operating element of the present invention, a porous high temperature operating element film with low film density is formed in a predetermined configuration on one surface of an insulating member with good heat conductivity, a resistive film with film density higher than that of the high temperature operating element film is formed in a predetermined configuration on the other surface of the insulating member. A lead wire is connected to the resistive film and the resistive film is further covered to form an insulating protective film on the insulating member.

Since the resistive film in the high temperature operating element in accordance with the present invention is formed by a thin film forming method, its pattern can be precise and the insulating protective film adhering to the resistive film prevents oxidation of the resistive film by the ambient, thereby suppressing changes in resistance during use. In addition, it acts to prevent the film from peeling off the substrate at the same time. In addition, since the element side is porous, a protective layer, an electron emitting layer, an insulating layer and the like can be easily provided.

An electron emitting apparatus in the high temperature operating element in accordance with the present invention comprises an insulating member with good heat conductivity, a resistive film with high density formed into a predetermined configuration on one surface of the insulating member using a material with a high melting point and good electrical conductivity. An insulating protective film is deposited to cover this resistive film, a porous reduction member with film density lower than that of the resistive film is formed into a predetermined configuration on the other surface of the insulating member using a material with good heat conductivity. An electron emitting member, is deposited on the reduction member, with a part thereof entering a hole in the reduction member.

According to the present invention, the protective film covering the resistive film protects the resistive film from the atmosphere and prevents the resistive film from peeling off the insulating member while it is used. In addition, since the reduction member is formed of a porous material, it can well adhere to the electron emitting member disposed on the reduction member. In addition, since part of the electron emitting member enters the reduction member, electrons can be emitted more effectively.

Furthermore, a method for manufacturing the thin high temperature heater in accordance with the present invention comprises forming a thin resistive film having a predetermined heater pattern on an insulating substrate depositing on an opposite surface of the substrate a protective film of a non-oxide insulating material, covering a surface of the thin resistive film with a protective film of a non-oxide insulating material, and baking the thin resistive film.

Since the surface of the thin resistive film is covered with the protective non-oxide insulating material in accordance with the present invention, oxidation of the resistive material and a change of resistance are prevented. Deterioration by the ambient is unlikely. Therefore, the temperature distribution on the surface is uniform regardless of the pattern configuration and reliability is improved. In addition, since the insulating substrate surface opposite to the thin resistive film is covered by the protective non-oxide insulating film, damage to the substrate due to a chemical action between the substrate and the thin resistive film is prevented and the heater function is not reduced. Furthermore, since the thin resistive film is baked, the resistive film is recrystallized before it is used as a heater and the resistance does not change during use.

DETAILED DESCRIPTION OF THE PREFERRED EMBODIMENTS

An embodiment of the present invention will be described in detail with reference to the drawings.

Figure 1:
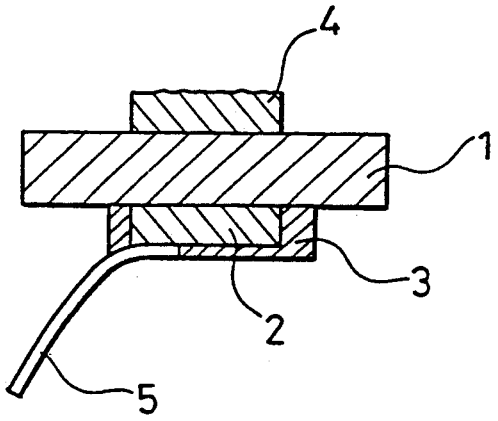
FIG. 1 is a sectional view showing a high temperature operating element according to a first embodiment of the present invention.

FIG. 1 is a sectional view showing a high temperature operating element in accordance with an embodiment of the present invention. In FIG. 1, reference numeral 1 designates a ceramic substrate (insulating substrate), reference numeral 2 designates a high density resistive film for a heater, reference numeral 3 designates a vitreous protective coating layer (insulating protective film), reference numeral 4 designates a porous low density film and reference numeral 5 is a lead wire. It is desirable that the following requirements are met for the respective materials. It is desirable that substrate 1 have good heat conductivity, a coefficient of thermal expansion close to that of the resistive film 2, be a good insulator, not likely to suffer dielectric breakdown at a high temperature, and be planar. Therefore, AlN, $Al_2O_3$ and the like are suitable. It is desirable that resistive film 2 have a low vapor pressure and a stable electric characteristic at high temperatures. Therefore, Mo, W, Pt, Ta, TiN, TiC, TiCN and the like are suitable. It is desirable that protective coating 3 diffuse inward a little at a high temperature and have a softening point or a melting point higher than the working temperature. Therefore, a vitreous material which is stable at a high softening point and a high melting point, such as $SiO_2$, $Al_2O_3$ and the like, is considered suitable. For example, in case of $SiO_2$, its softening point is 1710° C. (rock crystal) and melting point is 1470° C. (crystal) and in case of $Al_2O_3$, its melting point is 2030° C. Alternatively, a material such as CaO and $Y_2O_3$ which prevents splashing during baking may be used. For the lead wire 5, it is desirable that its material has the same characteristic and the same diffusion coefficient as those of the resistive film 2 and it is most desirable that its material is the same as that of the resistive film 2. It is desirable that element 4 be porous, so that it adheres well to a protective layer, a layer to which an electron emitting assistant is applied, an insulating layer and the like which are provided to improve its performance.

If constructed as shown in FIG. 1 with the above-described materials, it is possible to improve the performance of a high temperature operating element which is operated when a voltage is applied to the lead wire 5, a heater so that the resistive film 2 is heated and the element film 4 is heated from the rear. If an electron emitting assistant is applied to the element film 4, a high current density can be obtained from the element film 4, because the resistance thereof changes little even after it is used for a long time, therefore it is stable as a heater. In addition, the element film will not peel off because it is covered with a vitreous protective film and the electron emitting assistance can be well contained therein because it is porous. As a result, a high current density can be obtained from the element film 4.

Figure 12:
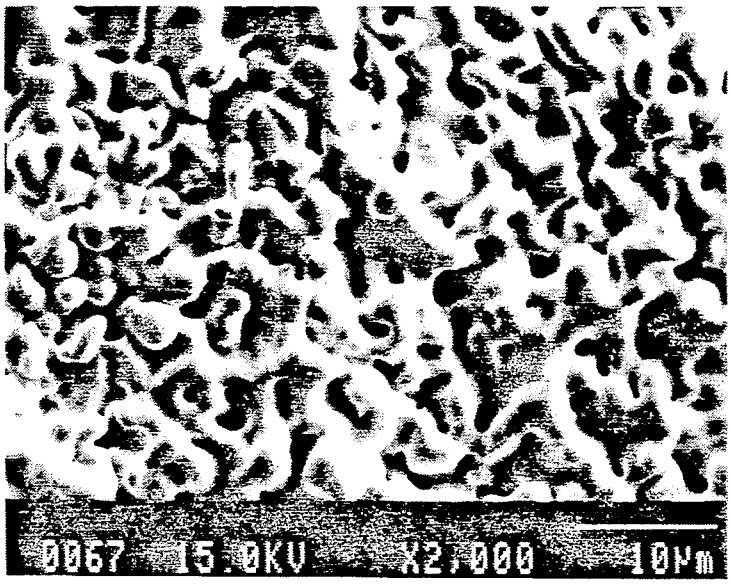
FIG. 12 shows the surface of a porous W-sintered substrate used in an embodiment of the invention.
Figure 13:
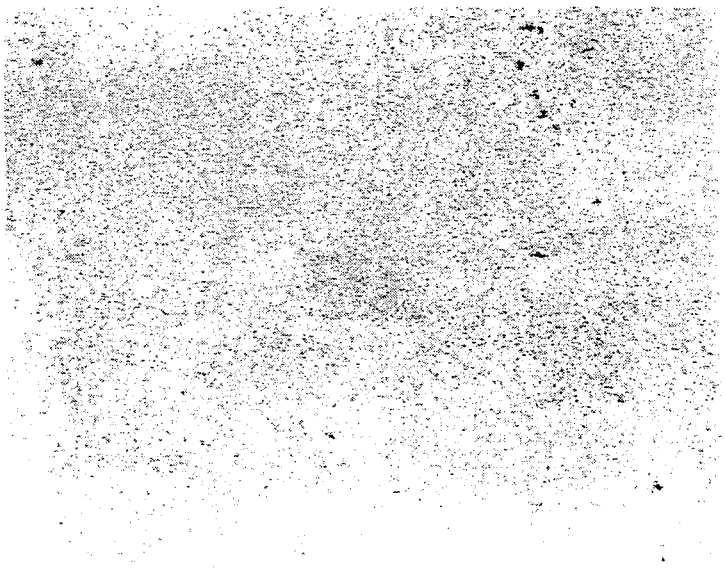
FIG. 13 shows the surface of a W-sputtered film.
Figure 14:
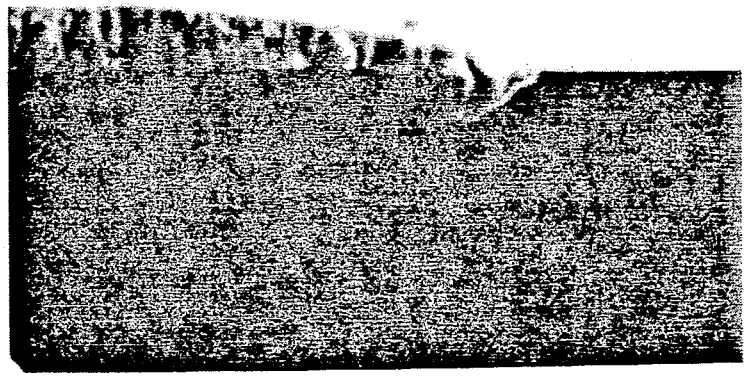
FIG. 14 shows a sectional view of an end of the conventional plain thin heater of the high temperature operating element after its use.

In this embodiment, in view of the above conditions, a description is given of a method for manufacturing the high temperature operating element in which W is applied to a substrate, W/AlN is used as a ceramic substrate, provided both the W and the substrate are baked at the same time. The resistive film 2 is formed by sputtering W. A vitreous "glaze" containing $SiO_2$ as a main component is applied as the protective coating layer 3. FIG. 12 shows a scanning electron microscope photograph of surface of the porous W-sintered substrate used in the embodiment. FIG. 13 shows an optical photograph of a surface of the W-sputtered film with the same magnification as in FIG. 12.

In FIG. 12, reference numeral 0067 designates film number, 15. OKV designates the accelerating voltage of the scanning electron microscope, ×2,000 designates the magnification, and the length of "10μm" designates an actual length in the photograph of 10 μm.

The W is applied to a side of the ceramic substrate (W/AlN substrate) and the W and the AlN substrate are baked at the same time and the W is patterned into a predetermined configuration by etching. The AlN side of the W/AlN substrate is mechanically polished to a mirror finish. A mask of a desired heater pattern is set on the substrate 1 and the W resistive film 2 with a predetermined thickness (a few μm–10 μm) is formed by sputtering. Then, the lead wire 5 is connected to a desired place by a method such as resistance welding. Then, the vitreous "glaze" is sprayed to cover the heater resistive film 2 and dried to form the coating layer 3. Then, it is baked for 5–10 minutes in vacuum, in hydrogen, or in an argon atmosphere to fuse on the W resistive film. The processing temperature at this time depends on the composition of the "glaze" and it is approximately 800°–1400° C. This "glaze" is a solution containing the so-called vitreous oxide material. For example, compositions of three kinds of glaze A, B and C are shown in table 1 and these are available in the market as glass type ceramic coating materials. The composition of frit shown in the table 1 is shown in a table 2 and it is the so-called vitreous oxide material. This vitreous material dissolves the metal oxide generated in small amount by the resistive film 2 while it is used as a heater and serves as a seal coat which buries any gap between metals, so that there is good adherence to the resistive film 2. In addition, since it is a vitreous material, it has a strong electrical insulating property and it will satisfactorily function as a high temperature heater.

TABLE 1

| | Composition on glaze (percentage by weight) | | |
|---|---|---|---|
| | A | B | C |
| Frit | 45.8 | 59.6 | 12.9 |
| Chromium oxide | 19.6 | — | — |
| Cupric oxide | — | 6.6 | — |
| Clay | 3.2 | 4.0 | 3.2 |
| Sodium nitrite | — | $1.7 \times 10^{-4}$ | $2.6 \times 10^{-4}$ |
| Water | 31.4 | 29.8 | 32.2 |
| Electrolytic chrome powder | — | — | 51.7 |

TABLE 2

| Composition of frit (percentage by weight) | | | | | | |
|---|---|---|---|---|---|---|
| $SiO_2$ | $Al_2O_3$ | $B_2O_3$ | CaO | $ZrO_2$ | BaO | ZnO |
| 37.8 | 1.0 | 6.4 | 3.5 | 2.5 | 43.8 | 5.0 |

When a protective layer, a layer to which an electron emitting assistant is applied, an insulating layer and the like are deposited on the element film surface in the next process, they are likely to adhere to it because it is a sintered porous film of W particles.

Distortion could occur between the substrate 1, the resistive film 2 and the protective film 3 due to a difference in coefficients of thermal expansion at high temperatures, but the vitreous material can flexibly close any gap as described above and it reduces the distortion. Therefore, even if it covers the whole surface, there is no problem in regard to distortion.

In addition, if a lead wire 5 which has also been covered with the same vitreous material is used, the effect is further improved.

Figure 2:
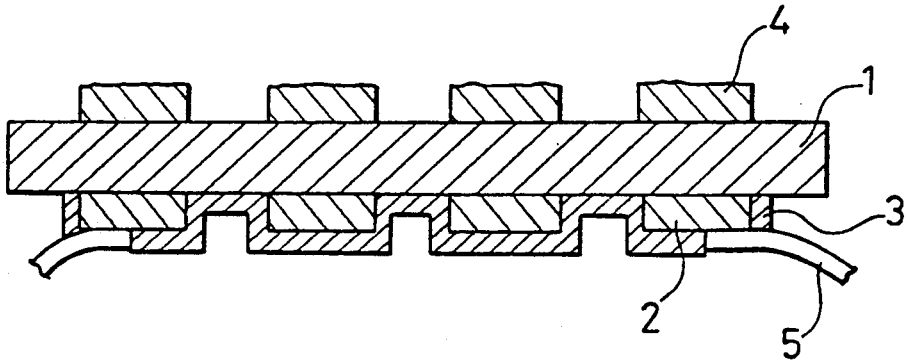
FIG. 2 is a sectional view showing a high temperature operating element according to a second embodiment of the present invention.

As shown in FIG. 2, the process can be performed over a large area of the ceramic substrate.

In addition, although a method for applying the "glaze" is described in the above embodiment, the protective coating layer 3 can be also formed by a PVD or CVD method in which a vitreous target is prepared and then the film is formed by sputtering.

As for the composition of the vitreous material, it is not necessarily the composite composition shown in the table 1 and it may be a single composition such as $SiO_2$ and $Al_2O_3$. For example, when the substrate is made of $Al_2O_3$ and the protective layer 3 $Al_2O_3$ it is not necessary to consider the influence of impurities and diffusion.

In the above embodiment, although a description was given of an example in which the high temperature operating element film is formed into a predetermined configuration on the simultaneously sintered W/AlN substrate by etching W, a W/AlN substrate having a screen printed pattern for elements may be used. In addition, the high temperature operating element film may be formed by etching a film formed by another method, such as thermal spraying and cladding, into a predetermined configuration so long as a porous surface is formed.

Although a method for forming the W resistive film 2 by sputtering was described in the above embodiment, a PVD method such as electron beam deposition, a laser PVD method, and ion plating or a CVD method using $WF_6$, $W(CO)_6$ and $WCl_6$ gas may be used. In addition, the same may be said in a case where a film made of, for example Mo and the like instead of W, is formed.

Although a wet process was not used in the above embodiment because the insulating substrate was made of AlN which reacts with water or alkali, a wet process may be used if the substrate is made of $Al_2O_3$ and the like.

Figure 3:
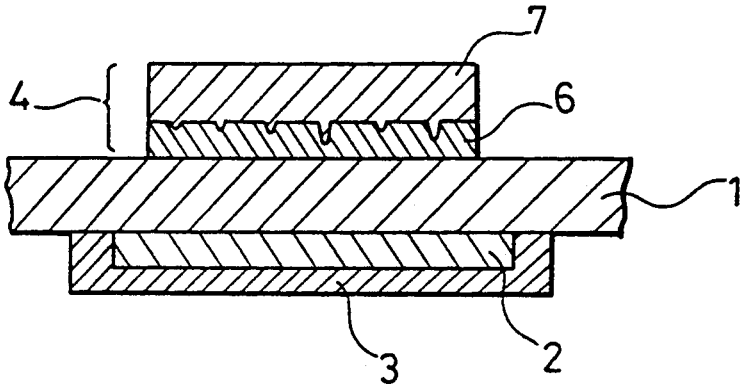
FIG. 3 is a sectional view showing an electron emitting element in a high temperature operating element according to the present invention.

An example of the high temperature operating element in accordance with the present invention, an electron emitting apparatus is now described. FIG. 3 is a sectional view showing an embodiment of an electron emitting apparatus of the present invention. In FIG. 3, reference numeral 7 designates an electron emitting member and reference numeral 6 designates a reduction member (base metal) comprising a low density, porous material which reduces the electron emitting member 7. A part of the electron emitting member 7 enters the holes in reduction member 6. Reference numeral 2 designates a high density resistive film heater for heating a cathode comprising the electron emitting member 7 and the reduction member 6. The film is formed into a predetermined configuration using a material having good electrical conductivity and a high melting point. Reference numeral 1 designates an insulating member made of an electrical insulating material with good heat conductivity, which is interposed between the reduction member 6 and the resistive film 2 to insulate electrically and effectively conduct heat generated from the resistive film 2 to the reduction member 6. Reference numeral 3 is a protective film covering the resistive film 2 for protecting it from an ambient.

Similar to the high temperature operating element shown in FIG. 1, the following properties are required for respective materials. The substrate 1 of the electron emitting apparatus, should have good heat conductivity, a coefficient of thermal expansion is close to that of the resistive film 2 and the reduction member 6, be a good insulator, not likely to suffer dielectric breakdown at high temperature and be planar. Therefore, AlN, $Al_2O_3$ and the like are suitable. It is desirable that resistive film 2 have a low vapor pressure and a stable electrical characteristic in a high temperature region. Therefore, Mo, W, Pt, Ta, TiN, TiC, TiCN and the like are considered suitable. Especially, TiN, TiC and TiCN are suitable because their crystallization temperature is high and they are stable at high temperature. For the protective coating layer 3, it is desirable that its material diffuse a little at high temperature and have a softening point or a melting point higher than the working temperature and be a good insulator. Therefore, a vitreous material such as $SiO_2$, $Al_2O_3$ and the like which is stable at a high softening point and a high melting point, or ceramics such as AlN and BN are considered suitable. For example, in case of $SiO_2$, the softening point is 1710° C. (rock crystal) and the melting point is 1470° C. (crystal) and in case of $Al_2O_3$, the melting point is 2030° C. Alternatively, a material such as CaO and $Y_2O_3$ which contains splashing during baking may be used. For the reduction member 6, it is desirable that its material have a low vapor pressure and a stable electric characteristic in a high temperature region, that it can reduce the electron emitting member 7, and that it is porous to strongly adhere to the electron emitting member 7.

In this embodiment, in view of the above-described condition, a description is given of a method for manufacturing the electron emitting apparatus, in which a monocrystalline sapphire substrate ($Al_2O_3$) is used as the insulating member 1, powdered W is sintered on the sapphire substrate as the reduction member 6, TiN is sputtered as the resistive film 2, AlN is sputtered as the insulating protective film 3, and the electron emitting member 7 (Ba, Sr, Ca) $CO_3$ is applied to the W reduction member 6. In addition, the surface of the porous W film used as the reduction member 6 in the embodiment is the same as that shown in the FIG. 12.

First, a sapphire substrate 1 having one surface ground to a mirror finished is prepared and a desired pattern for a cathode is screen printed on the other surface using W paste containing an organic solvent or baking assistant. Then, it is baked at a high temperature (1000°-1800° C.). The pattern on the side of the cathode is relatively simple, so that it's pattern is reliable even if the substrate is not mirror finished. Then, a mask of a desired heater pattern is set on the mirror surface to form a TiN film 2 with a desired thickness (a few μm–10 μm) by sputtering. Then, the AlN film 3 is formed on the surface having the heater pattern by sputtering to cover the resistive film 2. On the other hand, the electron emitting member 7 such as (Ba, Sr, Ca)$CO_3$ is applied to the surface of the W reduction member 6. As a result, the electron emitting apparatus is completed.

A constant voltage is applied to the resistive film 2 to heat the resistive film 2 to a predetermined temperature. The reduction member 6 and the electron emitting member 7 are heated through the insulating member 1 and a voltage is applied between a grid (not shown) and the cathode to attract electrons from the electron emitting member 7.

Since the resistive film heater 2 is recrystallized at high temperature and is stable at high temperature during the long term use of the electron emitting apparatus, there is a little resistance change. In addition, since the heater is covered with the protective film 3, it is not damaged by the ambient such as a residual gas which could cause corrosion and the like. Furthermore, the cathode is prevented from peeling off the substrate. Since the reduction member 6 is sintered and formed on the surface which does not have a mirror finish, it is highly adherent and stable at a high temperature. In addition, since it is porous, the electron emitting member 7 partially enters reduction member 6, so that it can adhere well to the electron emitting member 7 and a high current density can be stably obtained.

In addition, it is possible to uniformly mass-produce the electron emitting apparatus by collectively forming heaters and cathodes on the insulating member 1 over a large area and then dividing the product into separate chips.

The reason why the resistive film 2 is formed of a simple substance of TiC, TiN and TiCN or their mixture is that its recrystallized temperature is high and electrically stable at a high temperature. Although film 2 may be formed of a general heater material such as W or Mo like the reduction member 6, these materials remove oxygen (deoxidize) from the substrate of $Al_2O_3$ to form an oxide having a high vapor pressure and then deteriorate when used at a high temperature of approximately 1000° C. More specifically, the heater is etched away and its configuration changes. Therefore, the circumstances in which it can be stably used, for example the material chosen for the substrate 1, the operating ambient and temperature, are limited. However, W or Mo can be used below approximately 800° C.

Although a description was given of a method for forming TiC, TiN and TiCN as a heater material by sputtering, the heater can be formed by a PVD method such as ion plating, electron beam deposition, and laser PVD. Since it is used at a high temperature, a thermal CVD method using $TiCl_4$, $CH_4$, $NH_3$, and the like is considered best. In addition, plasma CVD may be used to form the film using the same source gas.

Although the monocrystalline $Al_2O_3$ substrate was used as the insulating member 1 in the above embodiment, an AlN sintered substrate and a substrate on which an AlN film is further formed may be used when the leakage current or insulation breakdown voltage limitations are not strict.

Although a description was given of a method for forming the reduction member 6 by screen printing using W paste, it may be formed by thermal spraying, cladding, or the like and then a pattern for a cathode may be formed by etching depending upon pattern precision.

Figure 4:
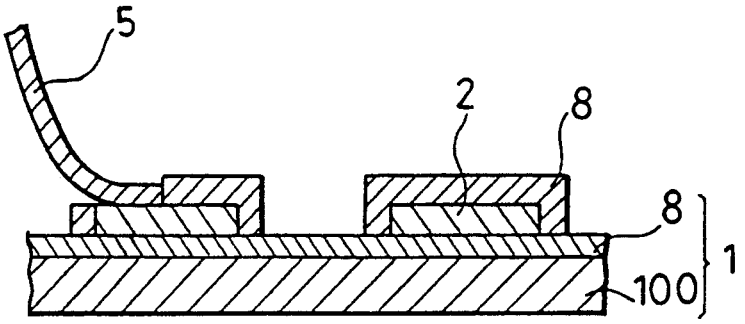
FIG. 4 is a sectional view showing a thin high temperature heater of a high temperature operating element according to a first embodiment of the present invention.

Next, a description is given of a structure of a thin high temperature heater part for the high temperature operating element of the present invention. FIG. 4 is a sectional view showing a thin high temperature heater in accordance with an embodiment of the present invention. In FIG. 4, reference numeral 1 designates an insulating substrate comprising a planar ceramic plate 100 and a protective film 8 of non-oxide insulating material, reference numeral 2 designates a thin film resistive heater and reference numeral 5 is a lead wire. It is desirable that the following requirements are met for respective material films as in the above embodiment. For example, for the insulating substrate, it is desirable that it have good heat conductivity, a coefficient of thermal expansion is close to that of the resistive film, be a good insulator, not likely to suffer breakdown at high temperature, and be planar so that it is not likely to be damaged by ambient gases. In order to provide an insulating substrate satisfying the above requirements, a protective non-oxide insulating film, such as AlN and BN, which has good heat conductivity and a thermal expansion coefficient close to that of the resistive film and is not likely to be damaged by the ambient is disposed on an oxide ceramic insulating material, such as $Al_2O_3$ and BeO, which is readily available in a monocrystalline state and which can be mirror finished by grinding on the surface opposite the thin film resistive film. However, this is not limited and a non-oxide insulating material satisfying the above-described conditions can be used in the same manner. In addition, as shown in FIG. 4, the protective non-oxide insulating material is not necessarily disposed on the whole surface of the oxide insulating material. The protective non-oxide insulating film may be disposed only on the surface opposite the thin film resistive film. Although the conventional thick resistive film formed by screen printing is several tens of μm thick the thin resistive film in accordance with the present invention has a thickness of 10 μm or less, so that its vapor pressure is low and its electrical characteristics are stable in a high temperature region. Therefore, Mo, W, Pt, Ta, TiN, TiC, TiCN and the like are considered suitable. For the protective non-oxide insulating material covering the thin resistive film, it is desirable that its material diffuse a little at a high temperature, it have a softening point or a melting point higher than the working temperature, and it is not likely to be damaged by the ambient. Therefore, AlN, BN and the like are considered suitable as above. For the lead wire, it is desirable that its material have the same characteristics and diffusion coefficient as those of the resistive film and it is most desirable that it is the same material as the resistive film.

Hereinafter, in view of the above conditions, a description is given of a method for manufacturing the thin high temperature heater in which $Al_2O_3$ (which is called alumina or sapphire) is used as a ceramic substrate, W is formed by sputtering as the thin film, resistive film and AlN is used as a protective non-oxide film insulating material.

An AlN film having a desired thickness (several μm–100μ) is uniformly formed on a planar $Al_2O_3$ substrate and then a W film having a desired thickness (several μm–10 μm) is formed by sputtering. Then, it is formed into a desired pattern configuration by wet or dry etching. For example, if it is formed by the wet etching, etching is performed in the following process.

A resist is applied.
↓
A mask is set.
↓
It is exposed.
↓
The resist is removed.
↓
W is etched away ($K_3[Fe(CN)_6]$ + NaOH solution)
↓
The resist is removed.

Then, it is baked at 800°-1000° C. in a hydrogen reducing atmosphere or an argon atmosphere until the resistance of the thin resistive film becomes stable. Smoothness which is generally hard to obtain in a sintered material such as the AlN substrate can be achieved by covering the planar $Al_2O_3$ substrate with the AlN insulating film. As a result, the profile irregularity of the resistive material formed thereon is improved and the reliability of the heater is also improved. Then, the lead wire is connected to a desired place by a method such as resistance welding. Then, the AlN protective film is formed by sputtering covering the thin resistive heater film to obtain a thin high temperature heater in accordance with one embodiment of the present invention.

Figure 5:
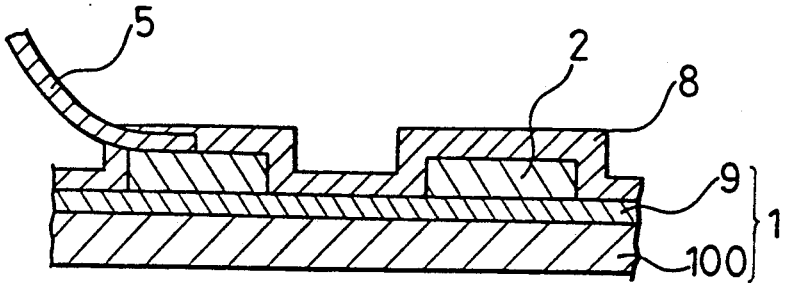
FIG. 5 is a sectional view showing a thin high temperature heater of a high temperature operating element according to a second embodiment of the present invention.

Although the protective non-oxide series insulating film was deposited only around the W film after the lead wire was connected in the thin high temperature heater in accordance with the above embodiment, it may be deposited on the whole surface of the substrate including the connection part as shown in a sectional view of FIG. 5. In this case, distortion between the substrate, the thin resistive film, and the protective film could be produced at high temperature because their thermal expansion coefficients are different. However, when AlN is used, distortion is prevented even if the whole surface is covered, because the thermal expansion coefficient of AlN is almost the same as that of W in comparison with $Al_2O_3$. As a result, AlN reduces the distortion generated between the substrate and the resistor.

Figure 6:
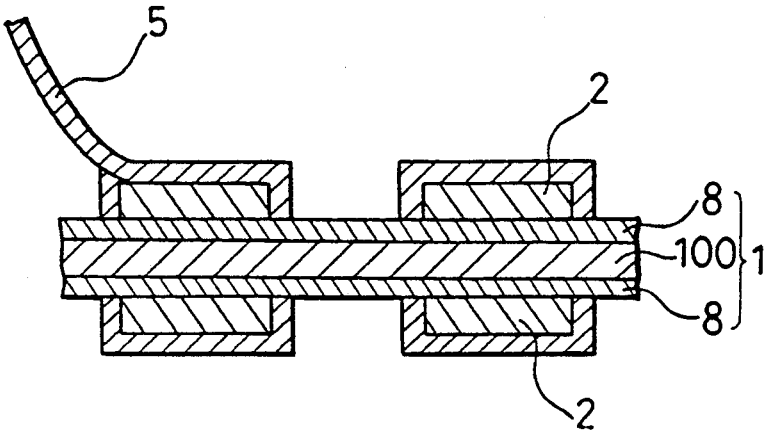
FIG. 6 is a sectional view showing a thin high temperature heater of a high temperature operating element according to a third embodiment of the present invention.
Figure 7:
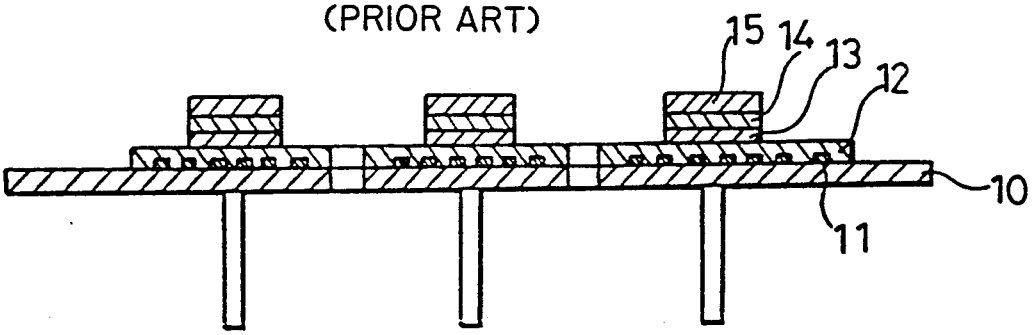
FIG. 7 (PRIOR ART)
FIG. 7 is a sectional view showing a conventional high temperature operating element formed by a thin film forming method.
Figure 8:
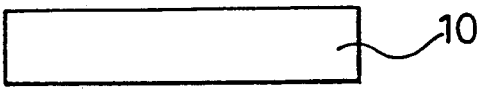
FIG. 8 (a) (PRIOR ART)
FIGS. 8 (*a*) to 8(*d*) are sectional views showing a method for manufacturing a conventional high temperature operating element.
Figure 8:
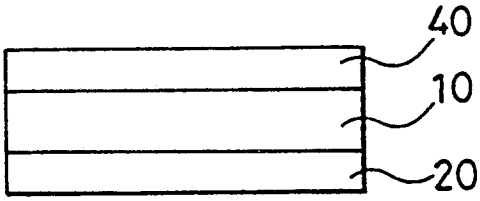
FIG. 8 (b) (PRIOR ART)
Figure 8:
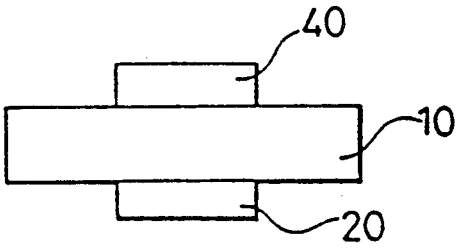
FIG. 8 (c) (PRIOR ART)
Figure 8:
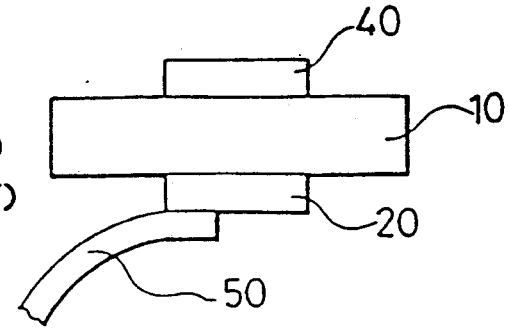
FIG. 8 (d) (PRIOR ART)
Figure 9:
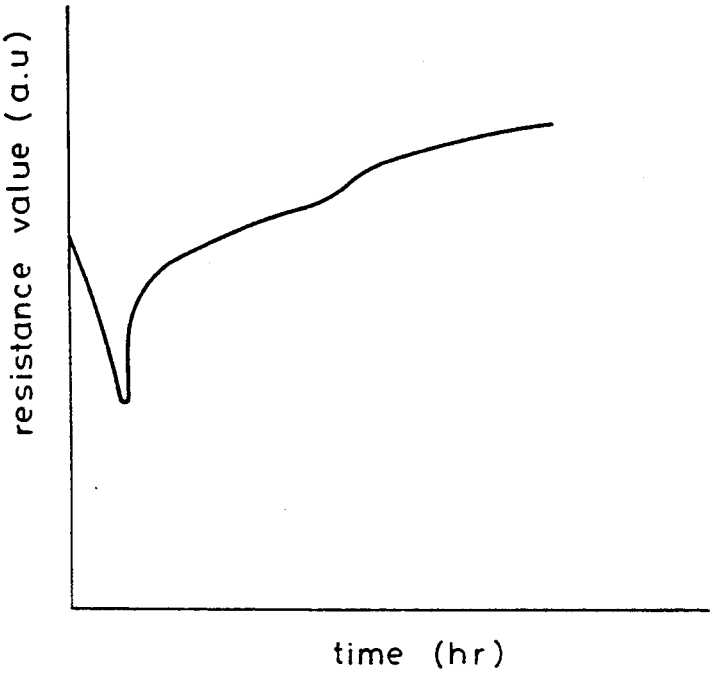
FIG. 9. (PRIOR ART)
FIG. 9 is a graph showing the change in the resistance of a heater of a conventional high temperature operating element with time.
Figure 10:
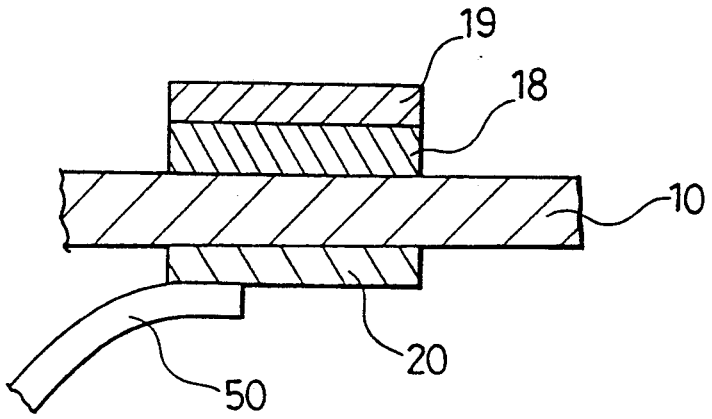
FIG. 10. (PRIOR ART)
FIG. 10 is a sectional view showing a conventional electron emitting apparatus.
Figure 11A:
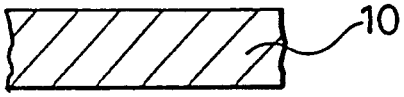
FIG. 11(a) (PRIOR ART)
FIGS. 11(*a*) to 11(*d*) are sectional views showing a conventional method for manufacturing a thin heater.
Figure 11B:
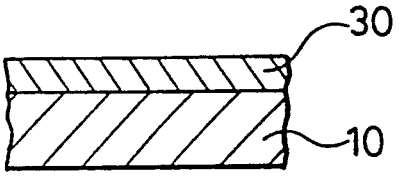
FIG. 11(b) (PRIOR ART)
Figure 11C:
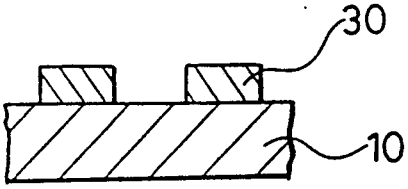
FIG. 11(c) (PRIOR ART)
Figure 11D:
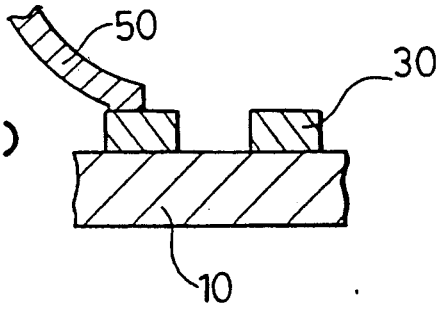
FIG. 11(d) (PRIOR ART)

In addition, it is also possible to process both surfaces of the ceramic substrate over a large area as shown in a sectional view of a thin high temperature heater in accordance with a still another embodiment in FIG. 6.

Although the AlN film was formed by sputtering, it may be formed by a PVD method such as electron beam deposition, laser PVD, ion plating and ionized cluster beam deposition or CVD.

Furthermore, although a description was given of method for forming the W film by sputtering in the above embodiment, it may be formed by a PVD method such as the electron beam deposition, laser PVD and ion plating or a CVD method using $WF_6$, $W(CO)_6$ and $WCl_6$ gas. In addition, the same is said when a film of Mo and the like, instead of W, is formed.

Although the thin resistive film was baked immediately after it was formed on the insulating substrate in the above embodiment, the baking sequence is not so limited and baking may be performed at any time so long as the thin resistive film is baked at least one time before being used.

As described above, according to the present invention, there is provided a high temperature operating element by forming a porous low density, high temperature operating element film with in a predetermined configuration on one surface of an insulating member, forming a resistive film having a higher density than that of the high temperature operating element film into a predetermined configuration on the other surface of the insulating member, connecting a resistive film to the lead wire, and covering the resistive film and the insulating member with an insulating protective. As a result, the operating film is prevented from peeling off the substrate and the high temperature operating element mounting has long-term reliability. Since the element film is porous, it adheres well to the protective layer provided so that the performance of the element can be easily improved.

According to the present invention, the electron emitting apparatus comprises an insulating member with good heat conductivity, a resistive film with a high density formed into a predetermined configuration on one surface of the insulating member using a material with good electrical conductivity and a high melting point, an insulating protective film covers the resistive film, a porous reduction member with a density lower than that of the resistive film formed into a predetermined configuration on the other surface of the insulating member, and an electron emitting member formed on the reduction member with one part entering holes in the reduction member. As a result, the resistive film is protected from the ambient by the protective film, the resistive film is prevented from peeling off the insulating member, and a stable heater is achieved. In addition, since the reduction member is formed of a porous material, it adheres well to the electron emitting member on the reduction member. In addition, since a part of the electron emitting member enters the reduction member, the electron emission is highly effective. As a result, an electron emitting apparatus with a long life, high performance, and high reliability is achieved.

Furthermore, according to the present invention, there is provided a thin high temperature heater comprising the high temperature operating element with the thin resistive film disposed on the insulating material in which at least the surface opposite to the thin resistive film is formed of the protective film of non-oxide insulating material, the surface of the thin resistive film is covered with a protective non-oxide insulating film and then the thin resistive film is baked. As a result, a thin high temperature heater with high reliability in which the resistance changes little is achieved.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A thermionic electron source comprising:

a substantially planar electrically insulating substrate having opposed first and second surfaces, the substrate including an oxide ceramic plate and a non-oxide protective film selected from the group consisting of aluminum nitride and boron nitride disposed on the plate and forming the first surface of the substrate;

a relatively high density electrically conductive film disposed on the first surface of the substrate as a heater;

a wire bonded to the conductive film as a heater lead;

a coating of the non-oxide protective film coating the electrically conductive film on the first surface of the substrate;

a relatively low density porous film disposed on the second surface of the substrate opposite the electrically conductive film; and a thermionic material disposed on the relatively low density porous film for emitting electrons when heated.

2. The electron source of claim 1 wherein the substrate is selected from the group consisting of alumina and beryllia.

3. The electron source of claim 1 wherein the porous film is sintered tungsten.

4. The electron source of claim 1 wherein the thermionic material is chosen from the group consisting of carbonates of barium, strontium, and calcium.

5. The electron source of claim 1 wherein the electrically conductive film is chosen from the group consisting of Mo, W, Pt, Ta, TiN, TiC, and TiCN.

* * * * *